US005929560A

United States Patent [19]

Trujillo et al.

[11] Patent Number: 5,929,560

[45] Date of Patent: Jul. 27, 1999

[54] FIELD EMISSION DISPLAY HAVING AN ION SHIELD

[75] Inventors: Johann Trujillo, Mesa; Chenggang Xie, Phoenix; Sung P. Pack, Tempe; Rodolfo Lucero, Scottsdale; Carl R. Hagen, Chandler; Lawrence N. Dworsky, Scottsdale, all of Ariz.

[73] Assignee: Motorola, Inc., Schaumburg, Ill.

[21] Appl. No.: 09/036,303

[22] Filed: Mar. 6, 1998

Related U.S. Application Data

[62] Division of application No. 08/740,583, Oct. 31, 1996, Pat. No. 5,760,535.

[51] Int. Cl.[6] ..... H01J 1/62

[52] U.S. Cl. ..... 313/495; 313/309; 313/313; 313/326

[58] Field of Search ..... 313/309, 310, 313/336, 351, 313, 334, 326, 352, 495

*Primary Examiner*—Vip Patel

*Attorney, Agent, or Firm*—S. Kevin Pickens; Kathleen Anne Tobin

[57] ABSTRACT

A field emission display (100) includes a dielectric layer (132) having a plurality of emitter wells (134), a plurality of electron emitters (136) disposed one each within the plurality of emitter wells (134), a plurality of conductive rows (138, 140, 142) disposed on the dielectric layer (132) and having sacrificial portions (154), an ion shield (139) disposed on the dielectric layer (132) and spaced apart from the sacrificial portions (154) of the plurality of conductive rows (138, 140, 142), and an anode (121) opposing the plurality of electron emitters (136) and defining a projected area (122) at the plurality of conductive rows (138, 140, 142). The sacrificial portions (154) of the plurality of conductive rows (138, 140, 142) extend beyond the projected area (122) of the anode (121).

34 Claims, 6 Drawing Sheets

FIELD EMISSION DISPLAY HAVING AN ION SHIELD

This application is divisional of U.S. patent application Ser. No. 08/740,583, entitled "Field Emission Device", filed on Oct. 31, 1996, now U.S. Pat. No. 5,760,535 and assigned to the same assignee.

FIELD OF THE INVENTION

The present invention pertains to the area of field emission devices and, more particularly, to field emission displays.

BACKGROUND OF THE INVENTION

It is known in the art to coat dielectric surfaces within display devices, such as cathode ray tube display devices, for preventing the accumulation of static electrical charge. The coating is typically a conductive material, such as a metal. It is desired to prevent the accumulation of static electrical charge because it can adversely affect the operation of the display device by, for example, attracting electrons that are desired to be directed toward the faceplate of the display. The use of a conductive material for preventing charging is desirable since a conductive material is the most efficient material for the removal of charge.

Field emission displays are known to have interior dielectric surfaces that are susceptible to electrostatic charging. For example, a dielectric layer is typically used to separate conductive rows and columns. The conductive rows and columns are used to selectively address the electron-emissive elements of the display. Portions of this dielectric layer are typically exposed to the vacuum within the device. For example, an exposed dielectric layer may exist at the periphery of the active area. The active area is defined by the electron-emissive elements.

Use within a field emission display of a conductive layer for preventing the accumulation of electrostatic charge presents several problems. First, the conductive material can potentially cause electrical shorting between the conductive rows/columns if the conductive material is in electrical contact with them. Second, triple junctions, which exist at the junction between a dielectric surface, a vacuum, and a conductive material, are known to cause breakdown of the dielectric material. Breakdown of the dielectric can result in the destruction of electron-emissive elements within the field emission display.

Accordingly, there exists a need for an improved field emission display, which has a conductive layer for the prevention of electrostatic charging and which overcomes at least some of the aforementioned problems.

Figure 1:
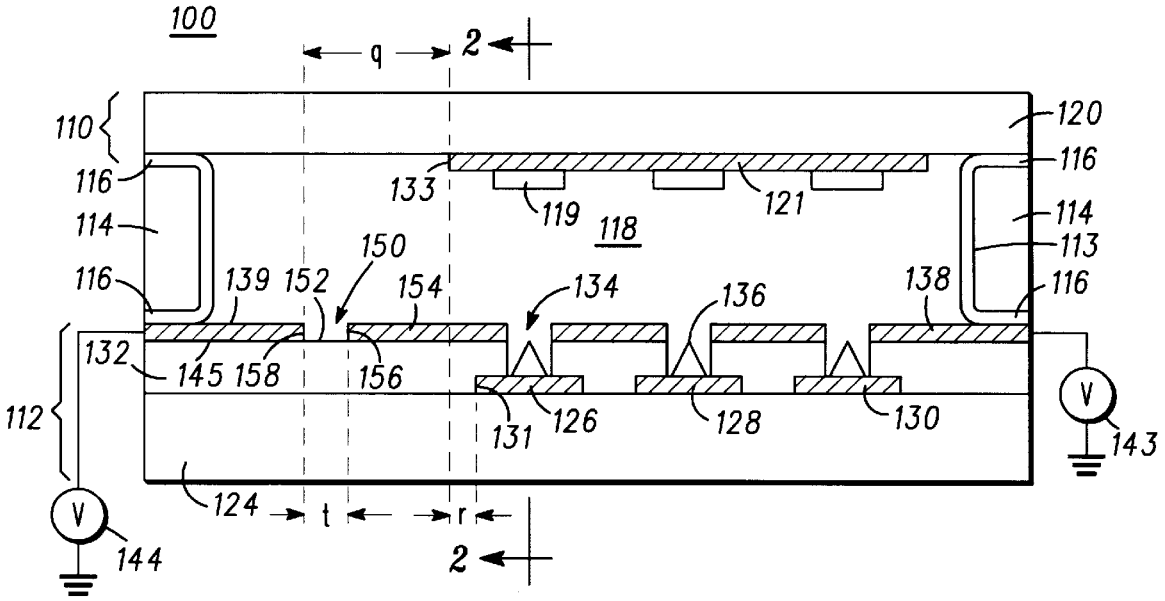
FIGS. 1 and 2 are cross-sectional views of a field emission display in accordance with an embodiment of the invention.

It will be appreciated that for simplicity and clarity of illustration, elements shown in the drawings have not necessarily been drawn to scale. For example, the dimensions of some of the elements are exaggerated relative to each other. Further, where considered appropriate, reference numerals have been repeated among the drawings to indicate corresponding elements.

DESCRIPTION OF THE PREFERRED EMBODIMENTS

The invention is for a field emission display having a plurality of conductive rows and an ion shield spaced apart from the plurality of conductive rows for preventing electrostatic charging. In a preferred embodiment of the invention, a gap is defined between the plurality of conductive rows and the ion shield. The gap is positioned within a region of low electric field during the operation of the field emission display. The field emission display has an anode, which provides a region of high electric field. The region of low electric field has a field strength that is less than that provided by the anode. The field strength of the region of low electric field is low enough to ameliorate destructive arcing and flashover events at the gap between the conductive rows and the ion shield.

Additionally, a field emission display in accordance with the invention further has electrodes that have sacrificial portions. In the event of a flashover or arcing event in the region of a gap adjacent the ion shield, the sacrificial portions may be damaged, while the electron emitters remain functional.

Figure 2:
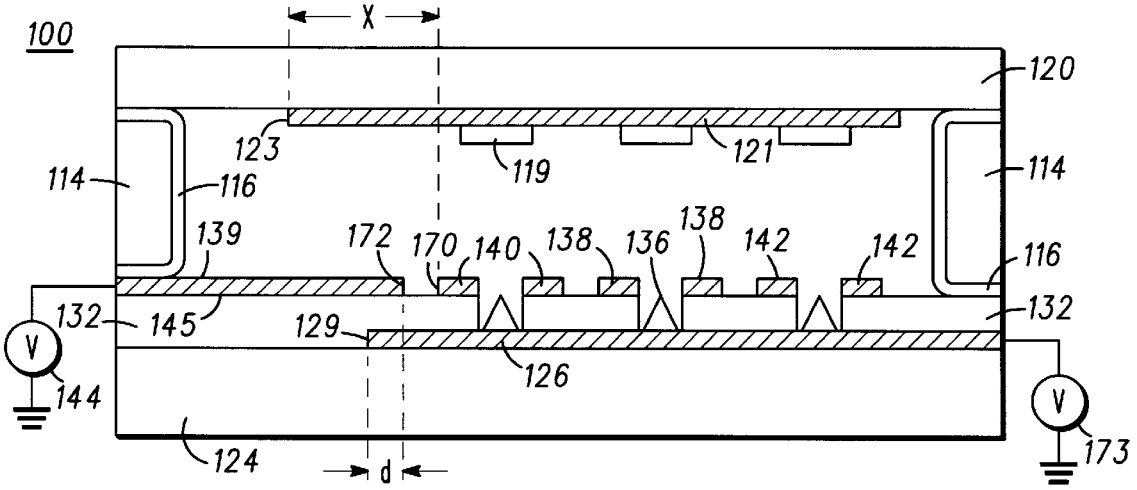
Figure 3:
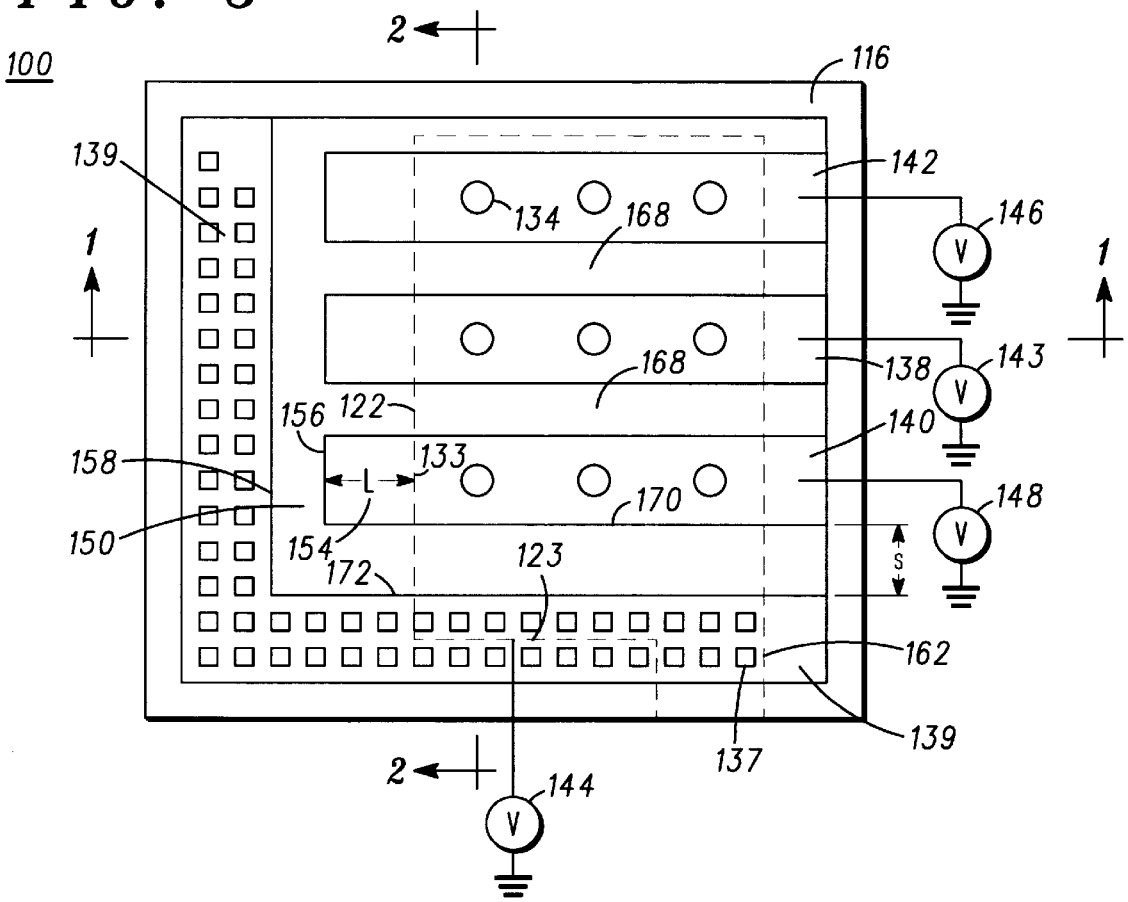
FIG. 3 is a top plan view of a cathode plate of the embodiment of FIGS. 1 and 2.

FIGS. 1 and 2 are cross-sectional views of a field emission display (FED) 100 in accordance with an embodiment of the invention; FIG. 3 is a top plan view of a cathode plate 112 of the embodiment of FIGS. 1 and 2. FED 100 includes cathode plate 112 and an anode plate 110. Cathode plate 112 opposes anode plate 110 and is spaced apart from anode plate 110 by a frame 114. Cathode plate 112, anode plate 110, and frame 114 define an interspace region 118. The pressure within interspace region 118 is less than about $10^{-6}$ Torr.

Cathode plate 112 includes a cathode substrate 124. Cathode substrate 124 is made from a dielectric material, such as glass, quartz, and the like. A plurality of conductive columns is disposed on cathode substrate 124. For ease of illustration, only a first conductive column 126, a second conductive column 128, and a third conductive column 130 are shown in the drawings. However, any number of conductive columns can be employed. Conductive columns 126, 128, and 130 are made from a convenient conductive material. Conductive columns 126, 128, and 130 are connected to voltage sources. As illustrated in FIG. 2, a voltage source 173 is connected to first conductive column 126 (voltage sources connected to conductive columns 128 and 130 are not shown).

Cathode plate 112 further includes a dielectric layer 132, which is disposed on conductive columns 126, 128, and 130. Dielectric layer 132 is made from a convenient dielectric material and has a plurality of emitter wells 134. An electron emitter 136 is disposed in each of emitter wells 134.

Cathode plate 112 further includes a plurality of conductive rows, which are disposed on dielectric layer 132. For ease of illustration only a first conductive row 138, a second conductive row 140, and a third conductive row 142 are illustrated in FIGS. 1–3. However, any number of conductive rows can be used. As illustrated in FIG. 3, each of conductive rows 138, 140, and 142 is connected to a voltage source 143, 148, and 146, respectively.

In accordance with the invention, each of conductive rows 138, 140, and 142 has a sacrificial portion 154. Sacrificial portion 154 defines an end of the row and an edge 156.

As illustrated in FIGS. 1 and 2, dielectric layer 132 defines a dielectric surface 145. Dielectric surface 145 is proximate to sacrificial portions 154 of conductive rows 138, 140, and 142.

In accordance with the invention, FED 100 further includes an ion shield 139. Ion shield 139 is disposed on dielectric surface 145. Ion shield 139 prevents electrostatic charging of dielectric surface 145.

Ion shield 139 is made from a conductive material, such as a metal, amorphous silicon, and the like. In the embodiment of FIG. 3, ion shield 139 extends along two of the four sides of FED 100. The invention is not limited to this configuration. An ion shield in accordance with the invention can extend along one, two, three, or more sides of the field emission display.

Ion shield 139 is preferably electrically isolated from conductive rows 138, 140, and 142 (108). As illustrated in FIGS. 1 and 3, an edge 158 of ion shield 139 is spaced apart from edges 156 of sacrificial portions 154. Ion shield 139 and each of edges 156 define a gap 150. As depicted in FIG. 1, a dielectric surface 152 is disposed between ion shield 139 and each of edges 156 of conductive rows 138, 140, and 142. Triple points are defined by dielectric surface 152, ion shield 139, and sacrificial portions 154 in conjunction with the vacuum of interspace region 118.

In accordance with the invention, gaps 150 are disposed in a region of low electric field strength. Configuring gaps 150 in a region of low electric field strength reduces flashover and electrical arcing events due to the presence of triple points in the region of gaps 150.

Furthermore, if and when electrical arcing events do occur in the region of gaps 150, row damage is restricted to sacrificial portions 154 of conductive rows 138, 140, and 142. The length, L (FIG. 3), of sacrificial portions 154 is selected to confine damage to sacrificial portions 154 and to prevent damage to electron emitters 136.

As illustrated in FIGS. 2 and 3, ion shield 139 is also spaced apart from a length-wise edge 170 of second conductive row 140. An edge 172 of ion shield 139 is generally parallel to length-wise edge 170 and is spaced apart from length-wise edge 170.

In the preferred embodiment and as further illustrated in FIG. 3, ion shield 139 has a plurality of holes 137. Holes 137 facilitate the removal of layers deposited on ion shield 139 during the fabrication of FED 100. Holes 137 are also useful for reducing film stresses within ion shield 139. The patterning geometry is not limited to square-shaped holes.

FED 100 further includes frame 114, which circumscribes electron emitters 136 and partially defines interspace region 118. Frame 114 is made from a dielectric material, such as glass, and is attached to the emitter structure using a frit sealant 116.

In the preferred embodiment, an interior dielectric surface 113 of frame 114 is coated with frit sealant 116. Coating interior dielectric surface 113 with frit sealant 116 is believed to reduce flashover and electrical arcing events in the vicinity of frame 114.

Further in accordance with the invention, ion shield 139 is connected to frit sealant 116. As illustrated in FIGS. 1–3, ion shield 139 extends under frit sealant 116. Ion shield 139 is also connected to a voltage source 144. Voltage source 144 allows independent control of the potential at ion shield 139.

Referring to FIGS. 1 and 2, anode plate 110 includes an anode substrate 120, upon which is formed an anode 121. Anode substrate 120 is made from a hard, transparent material, such as glass. Anode 121 is made from a transparent, conductive material, such as indium tin oxide. Anode 121 includes an anode connection 162 (FIG. 3), which is designed to be connected to a voltage source (not shown). A plurality of phosphors 119 are disposed on anode 121. Phosphors 119 are made from a cathodoluminescent material, which emits light upon electron excitation.

Anode 121 opposes conductive rows 138, 140, and 142. Anode 121 is useful for creating between anode 121 and electron emitters 136 an electric field having a high electric field strength.

In accordance with the invention and as illustrated with dashed lines in FIG. 3, anode 121 further defines a projected area 122 on conductive rows 138, 140, and 142. Projected area 122 includes the area of the emitter structure that directly opposes anode 121. The maximum electric field strength in FED 100 during its operation exists between projected area 122 and anode 121. In accordance with the invention, sacrificial portions 154 of conductive rows 138, 140, and 142 are disposed external to projected area 122.

FED 100 is made using deposition and pattering techniques known to one skilled in the art. For example methods for forming electron emitters 136 are known to one skilled in the art.

During the operation of FED 100, potentials are applied to conductive columns 126, 128, and 130, and to conductive rows 138, 140, and 142, for causing selective electron emission from electron emitters 136. A potential is applied to anode 121 for attracting the emitted electrons to phosphors 119.

An exemplary configuration of potentials will now be described. This configuration is in no way intended to be limiting. For example, ground potential is applied at conductive columns 126, 128, and 130; about 80 volts are applied at conductive rows 138, 140, and 142; and about 4000 volts are applied at anode 121. The distance between anode plate 110 and cathode plate 112 can be about 1 millimeter. Thus, the electric field strength between anode 121 and projected area 122 is about 4 volts per micrometer.

During the operation of FED 100, charged species are liberated into the vacuum of interspace region 118. Using voltage source 144, a potential is applied to ion shield 139 for conducting charge due to these charged species. In this manner, electrostatic charging of dielectric surface 145 is prevented.

Now will be described a configuration of elements of FED 100 useful for the exemplary operating voltages set forth above. Each of conductive columns 126, 128, and 130 have an end edge 129 (FIG. 2). Edge 172 (FIG. 2) of ion shield 139 opposes length-wise edge 170 of second conductive row 140. Conductive columns 126, 128, and 130 extend beneath ion shield 139, so that an overlapping distance, d (FIG. 2), between end edge 129 and edge 172 is less than or equal to 100 micrometers. Anode 121 extends beyond length-wise edge 170, so that an overlapping distance, x (FIG. 2), between a first edge 123 of anode 121 and length-wise edge 170 is about 1 millimeter. Adjacent rows define a gap 168 (FIG. 3). In the embodiment of FIGS. 1–3, the distance between length-wise edge 170 and edge 172 of ion shield 139 is equal to that of gap 168. For example, if the distance between adjacent rows at gap 168 is 30 micrometers, the distance, s (FIG. 3), between length-wise edge 170 and edge 172 is also equal to 30 micrometers. A distance, t (FIG. 1), between edges 156 of conductive rows 138, 140, and 142 and edge 158 of ion shield 139 is also about 30 micrometers. A distance, r (FIG. 1), between a length-wise edge 131 of first conductive column 126 and a second edge 133 of anode 121 is about 1 millimeter. A distance, q (FIG. 1), between second edge 133 of anode 121 and edge 158 of ion shield 139 is about 200 micrometers. The length, L, of sacrificial portions 154 is given by the difference between distances q and t. In this example, the length of sacrificial portions 154, L, is equal to 170 micrometers.

Figure 4:
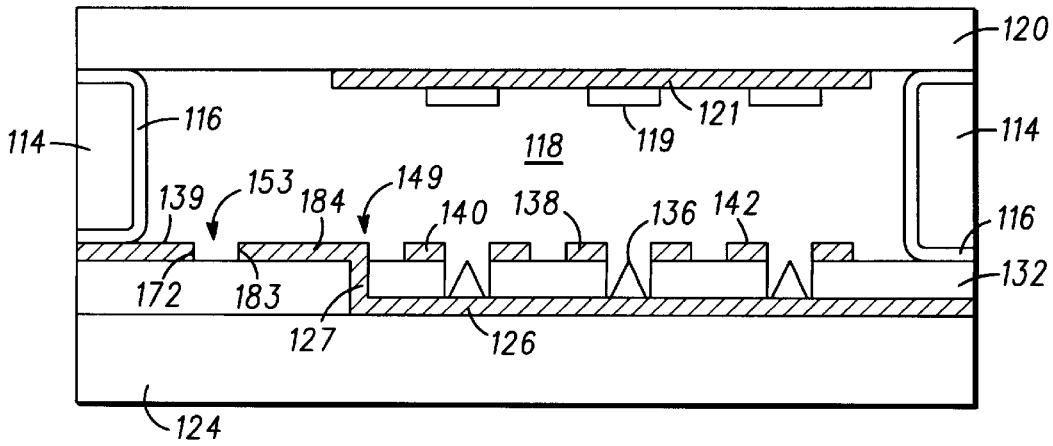
FIG. 4 is a cross-sectional view of a field emission display in accordance with another embodiment of the invention.
Figure 5:
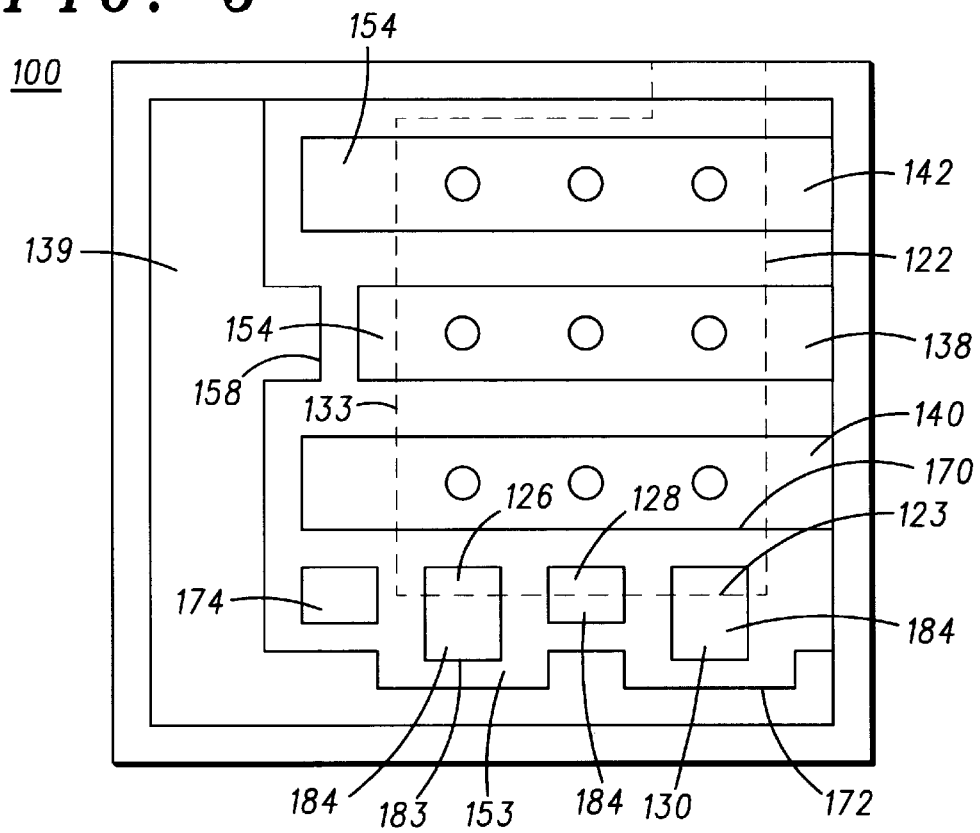
FIG. 5 is a top plan view of a cathode plate of the embodiment of FIG. 4.

Referring now to FIG. 4, there is depicted a cross-sectional view of FED 100 in accordance with another embodiment of the invention; FIG. 5 is a top plan view similar to that of FIG. 3 of the embodiment of FIG. 4 (voltage sources are not shown). In the embodiment of FIGS. 4 and 5, dielectric layer 132 further defines a plurality of column wells 149, and each of conductive columns 126, 128, and 130 further includes a connective portion 127 and a sacrificial portion 184. Connective portion 127 connects sacrificial portion 184 to the portion of the conductive column that is disposed on cathode substrate 124. The end of sacrificial portion 184 defines an edge 183.

Column wells 149 can be formed using convenient etching techniques for patterning dielectric layer 132. Connective portions 127 can be formed using deposition techniques for depositing material into via structures.

In accordance with the invention, edge 183 of each of sacrificial portions 184 and edge 172 of ion shield 139 define a gap 153. The length of sacrificial portion 184 is selected to position gap 153 within a region of interspace region 118 that has a lower electric field strength than that directly beneath anode 121. By reducing the electric field strength at gap 153, fewer flashover and arcing events occur due to the triple points in the vicinity of gap 153. As illustrated in FIG. 5, gaps 153 are preferably positioned external to projected area 122 defined by anode 121.

Furthermore, and in accordance with the invention, sacrificial portions 184 provide a sacrificial material, which can be selectively damaged in the event of flashover or arcing events in the region of gaps 153. Sacrificial portions 184 thus prevent damage to electron emitters 136, which are proximate to first edge 123 of anode 121. Sacrificial portions 184 are also useful for conducting charge due to impinging charged species. In this manner, electrostatic charging of the surface of dielectric layer 132 is reduced.

In the embodiment of FIGS. 4 and 5, sacrificial portions 184 of conductive columns 126, 128, and 130 are interdigitated with edge 172 of ion shield 139. In the embodiment of FIGS. 4 and 5, sacrificial portions 154 of conductive rows 138, 140, and 142 are similarly interdigitated with edge 158 of ion shield 139. It is believed that the interdigitated configuration further mitigates flashover and arcing events at the dielectric surfaces adjacent to ion shield 139.

Also in accordance with the invention, the embodiment of FIGS. 4 and 5 includes a sacrificial column 174 (FIG. 5). Sacrificial column 174 is similar to conductive columns 126, 128, and 130, with respect to configuration, dimensions, and material of construction. However, sacrificial column 174 is not employed for the excitation of phosphors 119. Sacrificial column 174 is the column that is most proximate to edge 158 of ion shield 139. Sacrificial column 174 extends generally parallel to edge 158.

Figure 6:
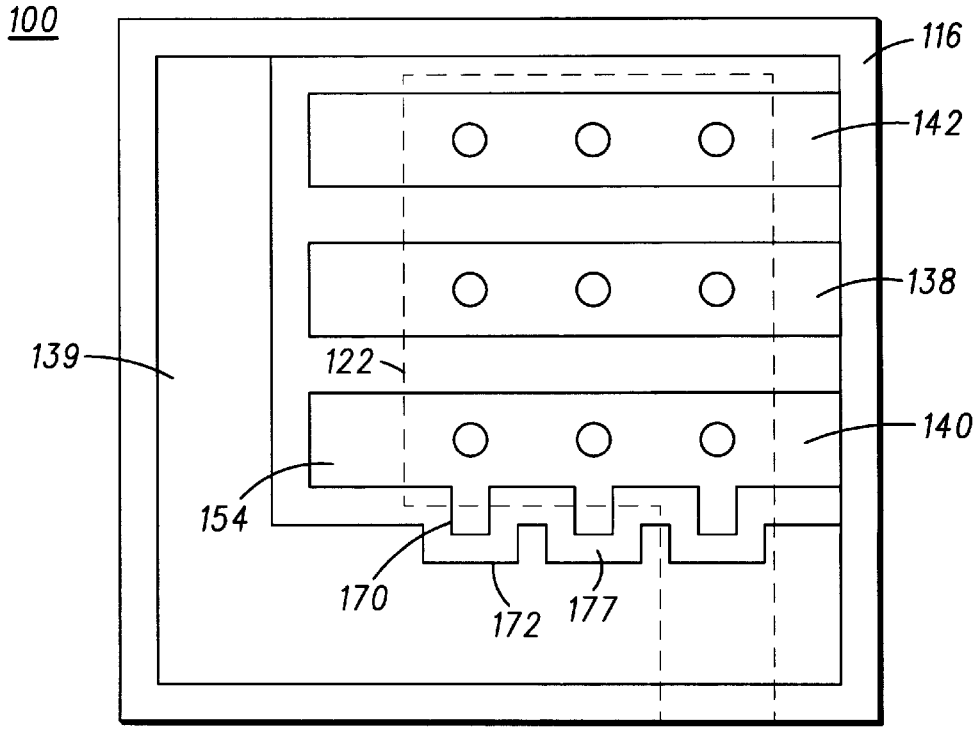
FIGS. 6–9 are views similar to that of FIG. 5 of a field emission display in accordance with additional embodiments of the invention.

Referring now to FIGS. 6–9 there are depicted views similar to that of FIG. 5 of FED 100 in accordance with additional embodiments of the invention. In the embodiment of FIG. 6, length-wise edge 170 of second conductive row 140 is interdigitated with edge 172 of ion shield 139. However, no sacrificial portions are included along length-wise edge 170. Interdigitation reduces the occurrence of flashover and arcing events. A gap 177 is defined by length-wise edge 170 and edge 172. The distance between length-wise edge 170 and edge 172 is preferably equal to the distance between adjacent rows.

Figure 7:
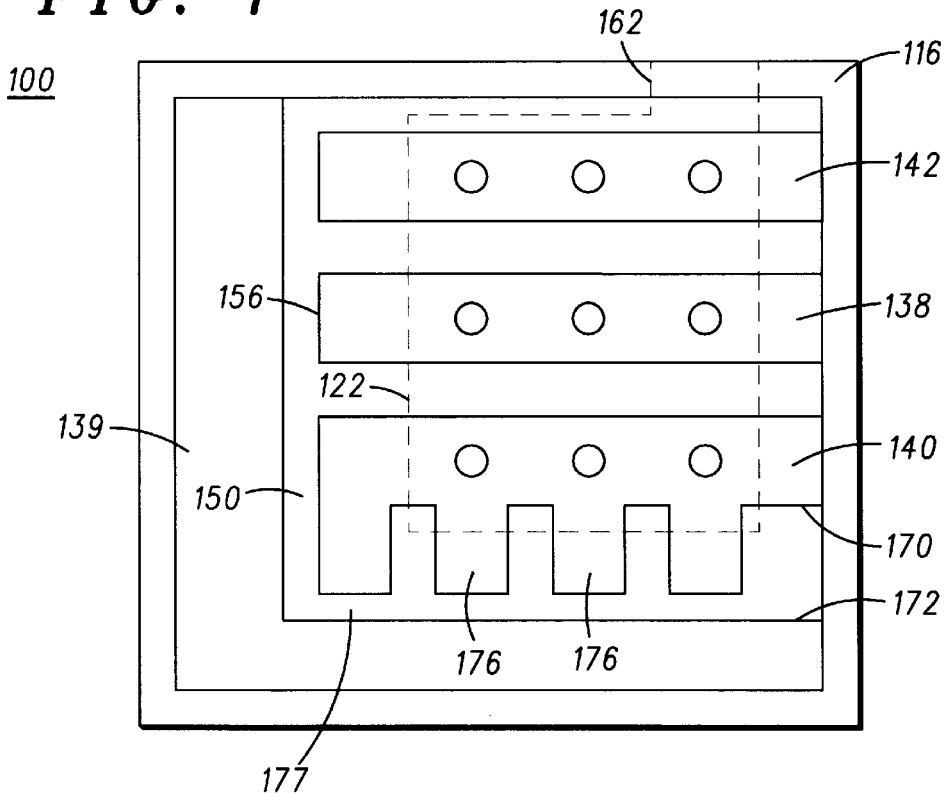

In the embodiment of FIG. 7, a plurality of sacrificial portions 176 are defined by extensions along length-wise edge 170 of second conductive row 140. Due to sacrificial portions 176, gaps 177 between edge 172 of ion shield 139 and length-wise edge 170 are positioned in a region of lower electric field strength than the field strength present in the region of projected area 122 defined by anode 121. A reduced electric field ameliorates flashover and arcing events.

Figure 8:
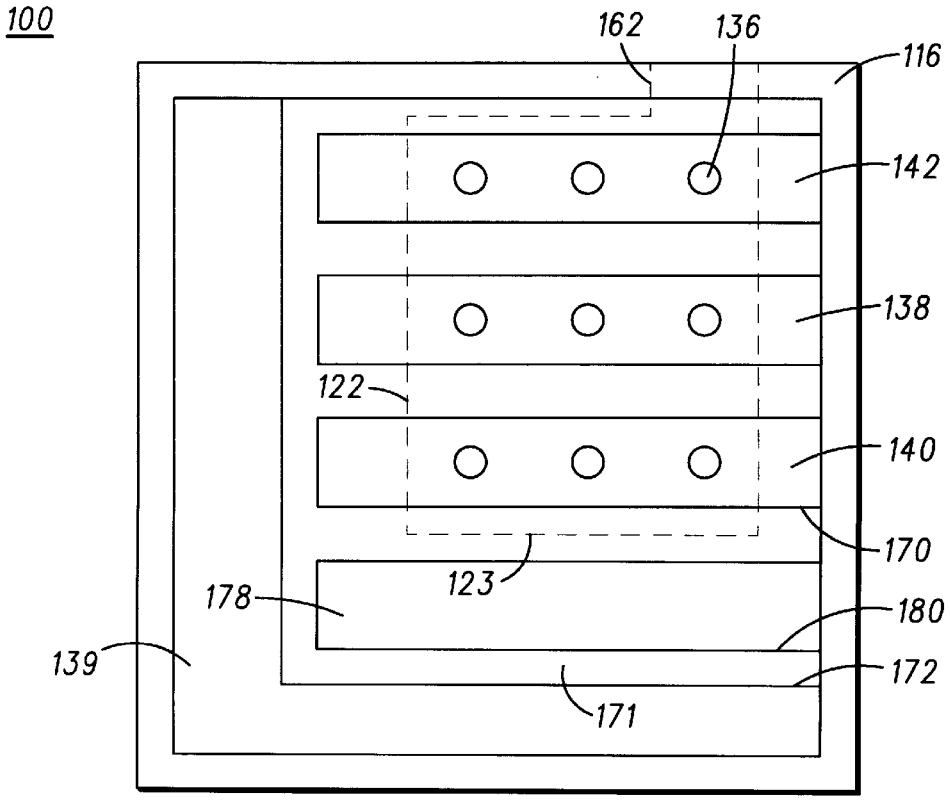

In the embodiment of FIG. 8 and in accordance with the invention, FED 100 includes a sacrificial row 178. Sacrificial row 178 is similar to conductive rows 138, 140, and 142, with respect to configuration, dimensions, and material of construction. However, sacrificial row 178 is not utilized to excite phosphors 119. More than one sacrificial row can be employed. A gap 171 defined by a length-wise edge 180 of sacrificial row 178 and edge 172 of ion shield 139 is removed from first edge 123 of anode 121. In this manner the electric field strength at gap 171 is reduced to ameliorate flashover and arcing events in the region of ion shield 139 and to prevent damage to electron emitters 136.

Figure 9:
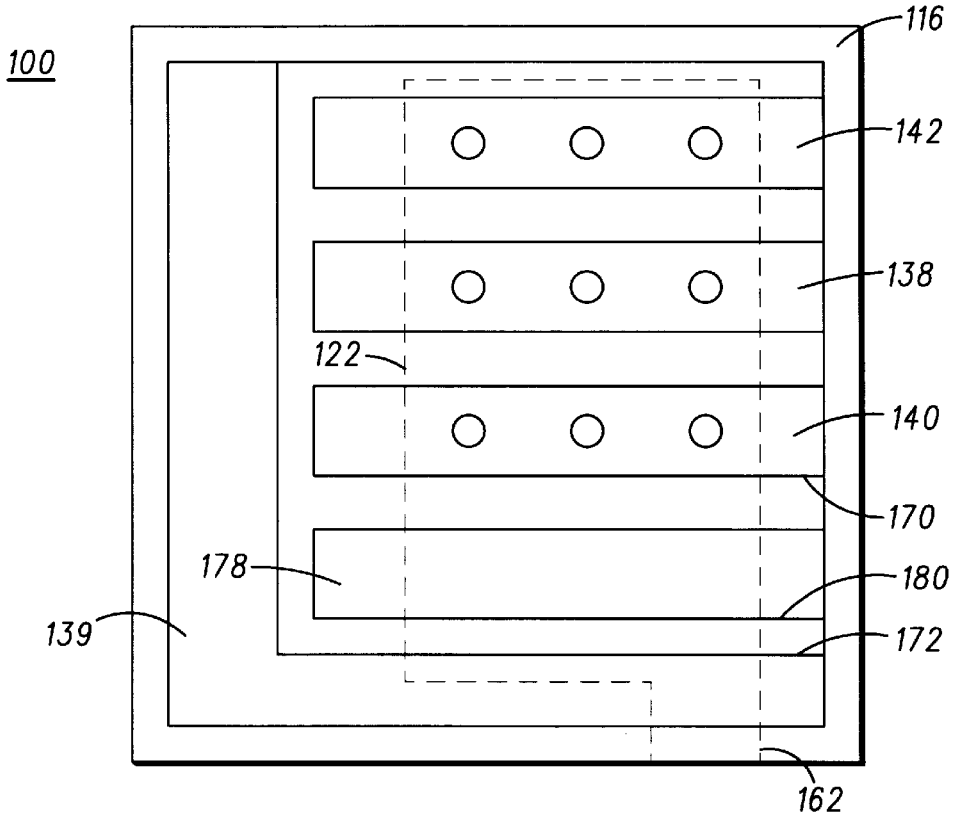

During the operation of the embodiment of FIG. 8, conductive rows 138, 140, and 142 are scanned. During the scanning steps, conductive rows 138, 140, and 142 are sequentially addressed with a potential that is useful for causing electron emission. Sacrificial row 178 can be included in the sequential scanning. Alternatively, the scanning of sacrificial row 178 can be omitted. In the embodiment of FIG. 9, projected area 122 of anode 121 extends over sacrificial row 178.

Figure 10:
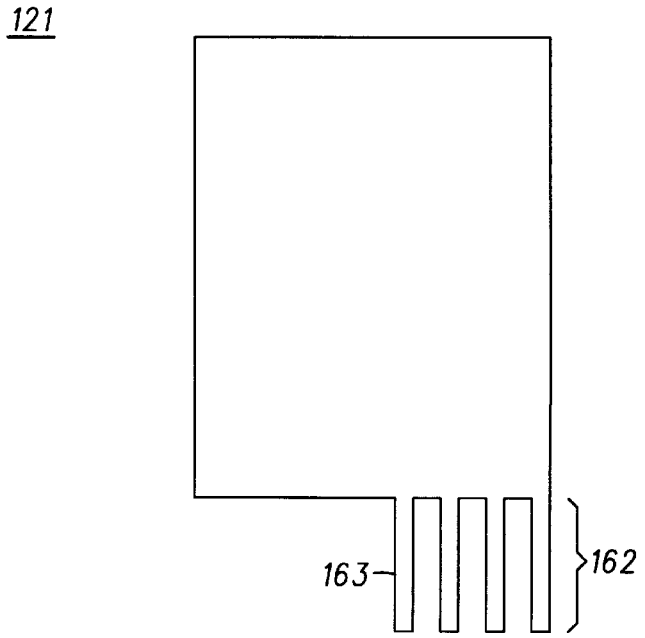
FIG. 10 is a top plan view of an anode of a field emission display in accordance with a further embodiment of the invention.

Referring now to FIG. 10, there is depicted a top plan view of anode 121 of FED 100 in accordance with a further embodiment of the invention. Anode connection 162 of anode 121 can be positioned to oppose a portion of ion shield 139 (FIGS. 3, 6, and 9). To reduce the electric field strength of the electric field between anode connection 162 and ion shield 139, anode connection 162 includes a plurality of strips 163.

Figure 11:
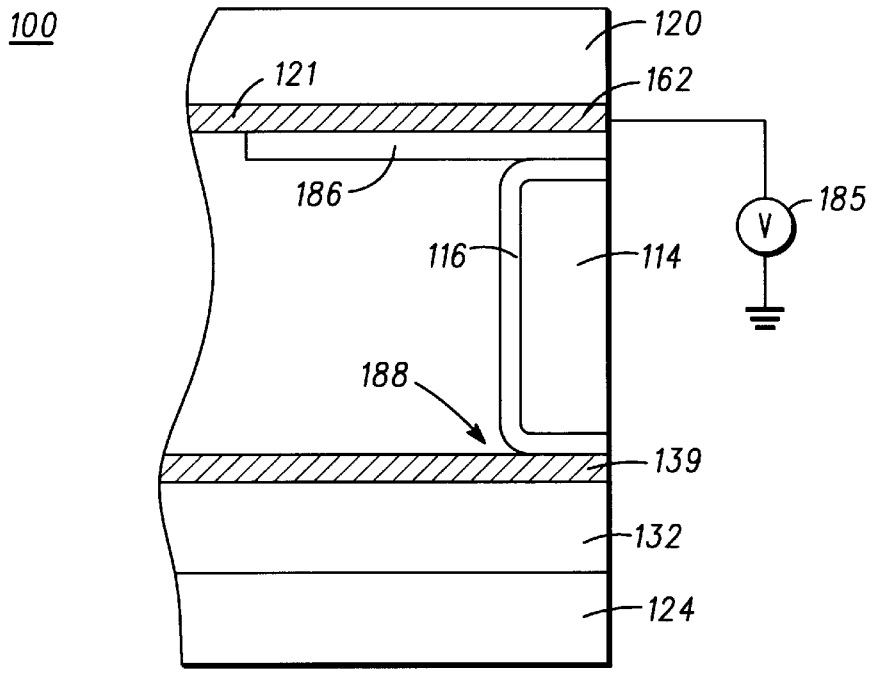
FIGS. 11 and 12 are partial, cross-sectional views of a field emission display in accordance with still further embodiments of the invention.
Figure 12:
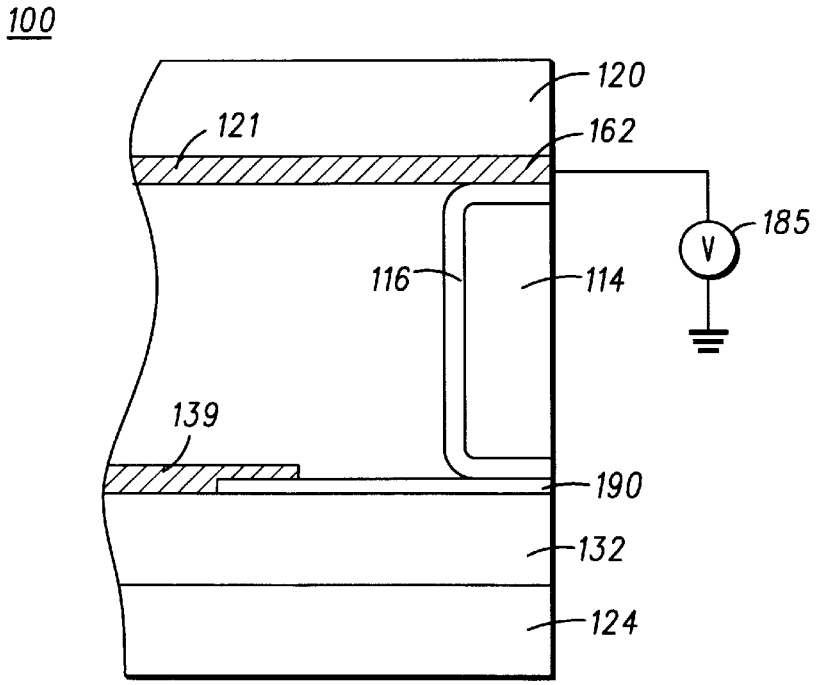

Referring now to FIGS. 11 and 12, there are depicted partial, cross-sectional views of FED 100 in accordance with still further embodiments of the invention. The embodiments of FIGS. 11 and 12 are useful for reducing the occurrence of flashover and arcing events in the vicinity of frame 114. As illustrated in FIGS. 11 and 12, anode connection 162 is connected to a voltage source 185.

In the embodiment of FIG. 11 and in accordance with the invention, FED 100 includes a dielectric layer 186. Dielectric layer 186 is disposed on anode connection 162 and opposes a portion of ion shield 139. It is believed that dielectric layer 186 reduces the formation of electrical arcs between anode connection 162 and ion shield 139 due to electron emission in the region of a triple junction 188.

In the embodiment of FIG. 12, FED 100 includes a resistive layer 190. Resistive layer 190 is disposed on dielectric layer 132. Resistive layer 190 extends between and is connected to ion shield 139 and frit sealant 116. Resistive layer 190 opposes anode connection 162. Resistive layer 190 is made from a material having a propensity for electron emission that is lower than that of ion shield 139. For example, resistive layer 190 can be made from silicon carbide, amorphous silicon, and the like.

In summary, the invention is for a field emission display having an ion shield. The field emission display of the invention includes electrodes having sacrificial portions and configurations that reduce the occurrence of flashover and arcing events in the region of the ion shield. The sacrificial portions further reduce damage to electron emitters.

We claim:

1. A field emission display comprising:

a plurality of conductive rows;

a dielectric surface proximate to the plurality of conductive rows; and an ion shield disposed on the dielectric surface and spaced apart from the plurality of rows.

2. The field emission display as claimed in claim 1, wherein the ion shield comprises a metal.

3. The field emission display as claimed in claim 1, wherein the ion shield is electrically isolated from the plurality of conductive rows.

4. The field emission display as claimed in claim 1, further comprising an anode, wherein the anode opposes the plurality of conductive rows and defines a projected area on the plurality of conductive rows, wherein each of the plurality of conductive rows comprises a sacrificial portion, and wherein the sacrificial portions of the plurality of conductive rows are disposed external to the projected area defined by the anode.

5. The field emission display as claimed in claim 1, further comprising an anode for providing a high electric field during operation of the field emission display, wherein the plurality of conductive rows defines an edge, wherein the edge defined by the plurality of conductive rows and the ion shield define a gap, and wherein the gap is disposed to be external to the high electric field during operation of the field emission display.

6. The field emission display as claimed in claim 1, further comprising a frame, wherein the frame circumscribes the plurality of conductive rows and comprises a frit sealant, and wherein the ion shield is connected to the frit sealant.

7. The field emission display as claimed in claim 6, wherein the frame comprises an interior dielectric surface, and wherein the interior dielectric surface is coated with the frit sealant.

8. The field emission display as claimed in claim 1, further comprising a frame and a resistive layer, wherein the frame circumscribes the plurality of conductive rows and comprises a frit sealant, and wherein the resistive layer is interposed between and connected to each of the ion shield and the frit sealant.

9. The field emission display as claimed in claim 1, wherein the ion shield is interdigitated with the plurality of conductive rows.

10. The field emission display as claimed in claim 1, wherein the ion shield defines a plurality of holes.

11. The field emission display as claimed in claim 1, further comprising a sacrificial row interposed between the plurality of conductive rows and the ion shield.

12. The field emission display as claimed in claim 1, further comprising an anode, wherein the anode opposes the plurality of conductive rows and comprises an anode connection, and wherein the anode connection comprises a plurality of strips.

13. The field emission display as claimed in claim 1, further comprising an anode and a dielectric layer, wherein the anode opposes the plurality of conductive rows and comprises an anode connection, and wherein the dielectric layer is disposed on the anode connection.

14. The field emission display as claimed in claim 13, wherein the dielectric layer opposes a portion of the ion shield.

15. A field emission display comprising:

a cathode substrate;

a plurality of conductive columns disposed on the cathode substrate;

a dielectric layer disposed on the plurality of conductive columns and defining a plurality of emitter wells;

an electron emitter disposed within each of the plurality of emitter wells;

a plurality of conductive rows disposed on the dielectric layer; and an ion shield disposed on the dielectric layer and spaced apart from to the plurality of conductive rows.

16. The field emission display as claimed in claim 15, wherein the ion shield comprises a metal.

17. The field emission display as claimed in claim 15, wherein the dielectric layer further defines a plurality of column wells, wherein each of the plurality of conductive columns comprises a connective portion and a sacrificial portion, wherein the connective portion is disposed in one of the plurality of column wells, and wherein the sacrificial portion is coextensive with the connective portion and is disposed on the dielectric layer.

18. The field emission display as claimed in claim 17, wherein the sacrificial portions of the plurality of conductive columns are spaced apart from the ion shield.

19. The field emission display as claimed in claim 17, further comprising an anode, wherein the anode opposes the plurality of conductive rows and defines a protected area on the plurality of conductive rows, wherein the ion shield and the sacrificial portion of each of the plurality of conductive columns define a gap, and wherein the gap is disposed external to the projected area defined by the anode.

20. The field emission display as claimed in claim 16, wherein the sacrificial portions of the plurality of conductive columns are interdigitated with the ion shield.

21. The field emission display as claimed in claim 15, further comprising a sacrificial column disposed on the cathode substrate and interposed between the plurality of conductive columns and the ion shield.

22. The field emission display as claimed in claim 15, wherein the ion shield is electrically isolated from the plurality of conductive rows.

23. The field emission display as claimed in claim 15, further comprising an anode, wherein the anode opposes the plurality of conductive rows and defines a projected area on the plurality of conductive rows, wherein each of the plurality of conductive rows comprises a sacrificial portion, and wherein the sacrificial portions of the plurality of conductive rows are disposed external to the projected area defined by the anode.

24. The field emission display as claimed in claim 23, wherein the sacrificial portion of each of the plurality of conductive rows and the ion shield define a gap, and wherein a distance between the gap and the projected area defined by the anode is sufficient to mitigate arcing and flashover at the gap and prevent damage of the electron emitters during operation of the field emission display.

25. The field emission display as claimed in claim 15, further comprising a frame, wherein the frame circumscribes the plurality of conductive rows and comprises a frit sealant, and wherein the ion shield is connected to the frit sealant.

26. The field emission display as claimed in claim 25, wherein the frame comprises an interior dielectric surface, and wherein the interior dielectric surface is coated with the frit sealant.

27. The field emission display as claimed in claim 15, further comprising a frame and a resistive layer, wherein the frame circumscribes the plurality of conductive rows and comprises a frit sealant, and wherein the resistive layer is interposed between and connected to each of the ion shield and the frit sealant.

28. The field emission display as claimed in claim 15, wherein the ion shield is interdigitated with the plurality of conductive rows.

29. The field emission display as claimed in claim 15, wherein the ion shield defines a plurality of holes.

30. The field emission display as claimed in claim 15, further comprising a sacrificial row interposed between the plurality of conductive rows and the ion shield.

31. The field emission display as claimed in claim 15, further comprising an anode, wherein the anode opposes the plurality of conductive rows and comprises an anode connection, and wherein the anode connection comprises a plurality of strips.

32. The field emission display as claimed in claim 15, further comprising an anode and a dielectric layer, wherein the anode opposes the plurality of conductive rows and comprises an anode connection, and wherein the dielectric layer is disposed on the anode connection.

33. The field emission display as claimed in claim 32, wherein the dielectric layer opposes a portion of the ion shield.

34. A field emission display comprising:

a cathode substrate;

a plurality of conductive columns disposed on the cathode substrate;

a dielectric layer disposed on the plurality of conductive columns and defining a plurality of emitter wells;

a plurality of electron emitters disposed one each within the plurality of emitter wells;

a plurality of conductive rows disposed on the dielectric layer, wherein each of the plurality of conductive rows comprises a sacrificial portion;

an ion shield disposed on the dielectric layer and spaced apart from the sacrificial portions of the plurality of conductive rows; and an anode opposing the plurality of electron emitters and defining a projected area, wherein the sacrificial portions of the plurality of conductive rows are disposed external to the projected area defined by the anode.

* * * * *